US005166118A

United States Patent [19]

Kretschmar et al.

[11] Patent Number: 5,166,118

[45] Date of Patent: Nov. 24, 1992

[54] CATALYST FOR THE HYDROGENATION OF HYDROCARBON MATERIAL

[75] Inventors: Klaus Kretschmar, Dorsten; Ludwig Merz, Recklinghausen; Klaus Niemann, Oberhausen; José Guitian, Dorsten; Julio Krasuk; Franzo Marruffo, both of Duesseldorf; Klaus Kurzeja, Gladbeck, all of Fed. Rep. of Germany

[73] Assignee: Veba Oel Technologie GmbH, Gelsenkirchen-Buer, Fed. Rep. of Germany

[21] Appl. No.: 340,535

[22] Filed: Apr. 19, 1989

Related U.S. Application Data

[62] Division of Ser. No. 105,290, Oct. 7, 1987, Pat. No. 4,941,966.

[30] Foreign Application Priority Data

Oct. 8, 1986 [DE] Fed. Rep. of Germany ..... 3634275

[51] Int. Cl.[5] ..... B01J 21/18; B01J 23/74

[52] U.S. Cl. ..... 502/185; 502/182; 502/338; 208/112

[58] Field of Search ..... 208/112, 143, 146, 108, 208/111 MC, 216 PP, 419, 423, 124

[56] References Cited

U.S. PATENT DOCUMENTS

| | | | |
|---|---|---|---|
| 3,635,943 | 1/1972 | Stewart | 208/112 X |
| 3,844,933 | 10/1974 | Wolk et al. | 208/112 X |
| 4,013,427 | 9/1966 | Sepulveda et al. | 208/112 X |
| 4,214,977 | 7/1980 | Ranganathan et al. | 208/423 X |
| 4,242,234 | 12/1980 | Schlinger et al. | 502/222 |
| 4,299,685 | 11/1981 | Khulbe et al. | 208/112 X |
| 4,435,280 | 3/1984 | Ranganathan et al. | 208/112 |
| 4,851,107 | 7/1989 | Kretschmar et al. | 208/108 |
| 4,941,966 | 7/1990 | Merz et al. | 208/112 |

*Primary Examiner*—Anthony McFarlane

*Attorney, Agent, or Firm*—Oblon, Spivak, McClelland, Maier & Neustadt

[57] ABSTRACT

A catalyst for the hydrogenation of a hydrocarbon material which is a member selected from the group consisting of red mud, iron oxides, iron ores, hard coals, lignites impregnated with heavy metal salts, carbon black, soots from gasifiers, and cokes produced by the hydrogenation of virgin residues, the catalyst being comprised of at least two separate particle size fractions such that the combined fractions have a particle size distribution between 0.1 and 2,000 microns with 10–40 wt. % of the particles having a particle size greater than 100 microns, and the mixture of fractions not being represented by a straight line when the accumulative weight of the particles vs. particle size which is plotted on log (minus log) vs. log graph paper has a correlation coefficient $R^2$ less than 0.96 as determined from the equation:

$$R^2 = \frac{[n\Sigma xy - (\Sigma x)(\Sigma y)]^2}{[n\Sigma x^2 - (\Sigma x)^2][n\Sigma y^2 - (\Sigma y)^2]}$$

wherein n is the number of experimental points, y is ln [−ln (n/1000)] and x is ln (dp), wherein dp is the particle size (μm) of the particles.

9 Claims, 4 Drawing Sheets

CATALYST FOR THE HYDROGENATION OF HYDROCARBON MATERIAL

This is a divisional application Ser. No. 07/105,290, filed Oct. 7, 1987, now U.S. Pat. No. 4,941,966.

BACKGROUND OF THE INVENTION

Discussion of Background

Depending on the conversion rate and hydrocracking operating conditions (pressure, temperature, gas/oil ratio etc.) and the tendency of the feedstock to produce coke; a catalyst or additive such as activated coke from hard coal or lignite, carbon black (soot), red mud, iron (III) oxide, blast furnace dust, ashes from gasification processes of crude oil mentioned before, natural inorganic minerals containing iron, such as laterite or limonite, amounting to from 0.5 to 15 wt. % of the liquid or liquid/solid feedstock is used in these slurry hydrogenation processes.

EP 0073527, representing one of the latest developments in technology, describes a catalytic treatment of heavy and residue oils in the presence of lignite coke which is mixed with catalytically active metals, preferably with their salts, oxides or sulfides or dust which is produced in the gasification of lignite, in a concentration of between 0.1 and 10 wt. % with respect to the heavy and residue oils. This catalyst or additive is used in the finest distribution with particle sizes of, for example, less than 90–100 microns.

U.S. Pat. No. 3,622,498 also describes a process that teaches that the asphaltene containing hydrocarbonaceous feedstock may be converted by forming a reactive slurry of the asphaltenes—containing the hydrocarbonaceous feedstock, hydrogen and a finely divided catalyst containing at least one metal from the group VB, VIB or VIII and reacting the resulting slurry at 68 bar and 427° C.

U.S. Pat. No. 4,396,495 describes a process for the conversion in slurry reactors of hydrocarbonaceous black oil using a finely divided, unsupported metal catalyst like vanadium sulfide with a particle size of between 0.1 and 2000 microns, a preferred range of 0.1 to 100 microns, where an antifoaming agent based on silicone is also fed to the conversion zone to reduce the foam formation that is produced at the conditions where the reaction takes place (temperature up to 510° C., pressure of about 204 bar and catalyst concentration of about 0.1 wt. % to 10 wt. %). This method is not adequate for temperatures higher than about 430° C.; due to the decomposition of the silicone as this loses its activity, also the silicone agent remains in the low boiling point fractions producing difficulties in the upstream processing.

Canadian 1,117,887 describes a hydrocracking process for the conversion of heavy oils to light products where high pressure and temperature are employed. The heavy oil is put in contact with a catalyst which is finely divided coal carrying at least one metal of group IVA or VIII of the periodic table where the coal is a subbituminous coal having a particle size of less than 100 mesh (<149 microns).

U.S. Pat. No. 4,591,426 which also describes a process of hydroconversion of heavy crudes with at least 200 ppm metal content using natural inorganic materials as a catalyst such as laterite or limonite which have a particle size of between 10 and 1000 microns at temperatures higher than 400° C. and total hydrogen pressure of 102 bar.

When the reactor zone is a moving bed-reactor, feeding an amount of 1.0 to 15 wt. % based on the feedstock where the reactants in said reaction zone are between 20 wt. % and 80 wt. % and a particle size of between 1270 and 12700 microns is employed.

Those skilled in the art of hydrocarbon processing have not recognized that under conditions which are normally used in catalytic slurry reactors of the bubble column type, using inexpensive catalysts or additives like these previously described may produce foam, which reduces the amount of liquid in the reaction zone when higher gas velocities of more than 3 cm/sec are employed. These higher gas velocities are also employed in industrial reactors.

SUMMARY OF THE INVENTION

Accordingly, one object of the present invention is to provide a process for upgrading heavy and residual oils which does not result in excess foam formation.

Another object of the invention is to provide a process which fully utilizes the reaction zone of the hydrogenation reactor.

These and other objects which will become apparent from the following specification have been achieved by the present process for the hydrogenation of heavy oils, residual oils, waste oils, shale oils, used oils, tar sand oils and mixtures thereof, which comprises the steps of:

i) contacting said oil with 0.5–15 wt. % of an additive to produce a slurry, said additive being selected from the group consisting of red mud, iron oxides, iron ores, hard coals, lignites, cokes from hard coals, lignites impregnated with heavy metal salts, carbon black, soots from gasifiers, and cokes produced from hydrogenation and virgin residues, and ii) hydrogenating said slurry with hydrogen at a partial hydrogen pressure of between 50–300 bar, a temperature between 250°–500° C., a space velocity of 0.1–5 $T/m^3h$ and a gas/liquid ratio between 100–10000 $Nm^3/T$, wherein said additive comprises particles having a particle size distribution between 0.1 and 2,000 microns, with 10–40 wt. % of said particles having a particle size greater than 100 microns.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
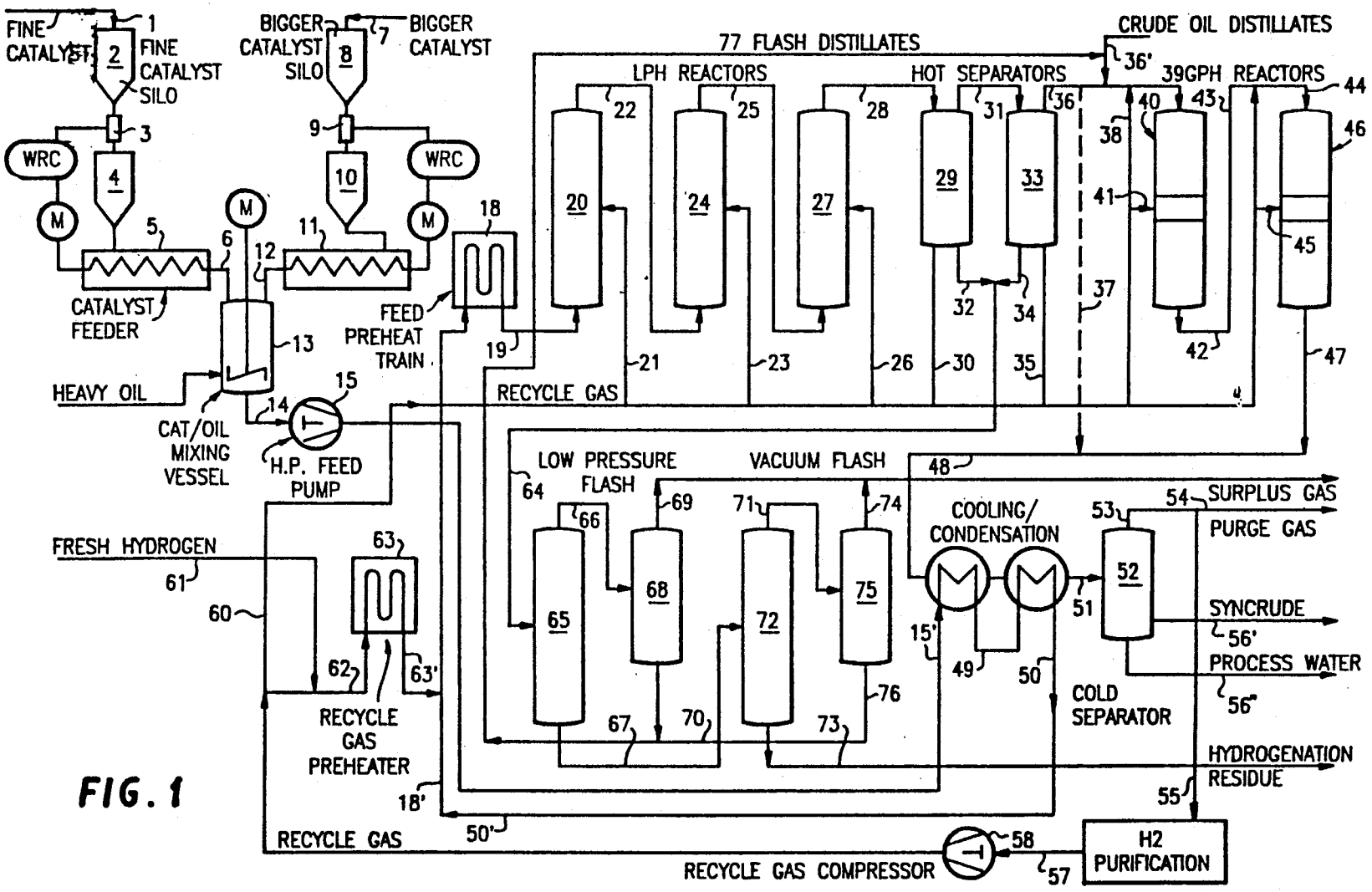
FIG. 1 describes the hydroconversion process of the present invention with additional distillation and hydrodesulfurization procedures.

The present invention is a process for upgrading heavy oils derived from any source such as petroleum, shale oil, tar sand, etc. These heavy oils have high metal, asphalt and conradson carbon contents. Typical metal concentrations (vanadium and nickel) are higher than 200 ppm, asphaltenes higher than 2 wt. %, conradson carbon is greater than 5%, and more than 50 wt. % of the residue fraction boils at a temperature of more than 500° C.

It is for the first time here disclosed that from the fluiddynamic point of view, for a given gas velocity larger particles inside the reactors help to increase the amount of liquid where the hydrocracking reaction takes place.

The present invention achieves the full utilization of the reaction zone employing two independent feeding systems of two catalyst or additive streams, where two different catalyst particle sizes are employed.

Accordingly, in one embodiment, the invention comprises a process for the conversion of heavy crudes with a density of less than 20° API, more than 200 ppm metals and more than 5 wt. % conradson carbon by contacting the feedstock in the reaction zone with hydrogen and a catalyst or additive in an upflow co-current three-phase bubble column reactor.

The catalyst may be any metal of the group VB, or VIB or VIII alone or any porous support on which metals available as organometallic species in the heavy crude can deposit.

It has been found that larger particles in the particle size range of 100 microns or more, are able to diminish the amount of foam formed inside the reactors, for gas velocities in use in commercial scale reactions (3 cm/s and more) when added in a proportion not less than 0.1 wt. %, preferably 0.5 wt. %, over the heavy oil fed to the hydrocracker. The significance of the present invention is due to the fact that when foam inside the reactors is reduced, the liquid phase reaction volume is increased, which allows one to achieve the desired conversion of 500° C.+ residue into distillates at a moderate temperature level.

Also, the present invention has uncovered the fact that to achieve very high conversion (90% or more) of 500° C.+ residues, at reasonably high space velocities 0.5 $t/m^3.h$ or more) a considerable fraction of small particles (less than 50 microns), is required because here it has been discovered that this brings considerable benefit to the hydrogenation capacity of the catalyst system being added.

Even though thermodynamic, fluiddynamic and kinetic relationships in the upflow slurry hydrogenation reactors together with the addition of additives or catalysts have so far not been totally clarified, it is believed that a certain amount of a larger particle fraction (which depends on the fluiddynamic conditions), decreases the foam formation or the gas retention, increasing the amount of liquid at the expense of the gas portion inside the reactor as is expressed by the reactor pressure head, residue conversion rate and preheating temperature. This phenomenon is detected when the gas velocity in the reactor is higher than 3 cm/sec and the temperature higher than 250° C. with a pressure range between 50 bar and 300 bar. A practical measure of the hydrogenation capacity of the catalyst system being employed is the ratio ($X_A/X_R$), where $X_A$ is asphaltene conversion (DIN method 51525), and $X_R$ is the vacuum residue 500° C. conversion, which for best conditions to avoid asphaltene precipitation and further coke deposition should be near unity. Here it has been demonstrated that the ($X_A/X_R$) ratio is nearer to unity when a weight % of not less than 1 wt. % above the heavy oil feed, of the smaller particles (less than 50 microns) is employed for high residue conversions ($X_R \geqq 87\%$ conversion).

These facts have led for the first time to the instrumentation of a dual feeding system for adding the most desired particle size distribution for the optimum use of a hydrocracker reactor of the bubble column type.

Two different and independent feeding systems are used to provide the system with the necessary fluiddynamic requirements and to maximize the liquid content inside the reaction zone. One of these feeding systems is employed to feed the high activity catalyst fraction with a particle size below 100 microns with a more preferred particle size below 50 microns and the second feeding system is employed to feed a less active catalyst or inert material with a particle size in the range of 100 microns to 2000 microns, most preferred is the range of 700 microns to 7000 microns.

The preferred catalyst mixture, formed by the additive of the two different catalyst particle size distributions can also be made beforehand in other separate devices, employing only one feeding system to contact the catalyst or additive with the oil. The remarkable feature of the present invention is that two different particle size distributions of the catalyst or additive of the same or of different chemical species are used in the reacting system.

The process of this invention comprises a hydroconversion in which a heavy oil feedstock is contacted with hydrogen and a catalyst or additive like activated coke or lignite carbon black (soot), red mud, iron (III) oxide, blast furnace dust, ashes from gasification processes of heavy oil, natural inorganic minerals containing iron such as limonite or laterite, amounting to from 0.5 wt. % to 15 wt. % related to the liquid. Where these catalysts or additives are fed to be mixed with the heavy crude employing two different and independent feeding systems, one feeding system is employed to feed the most active catalyst which is characterized by a small particle size which is preferred to be less than 100 microns. The second feeding system is employed to feed the catalyst fraction that helps the fluiddynamic behaviour of the liquid phase reaction system increasing the amount of liquid inside the reactor where the critical characteristic of this fraction is the particles size which should be between 100 microns and 2000 microns, with a size between 700 and 7000 microns being most preferred.

The proportion of the larger particles is to be between 5 and 80 wt. %, preferably 10 to 30 wt. % based on the total amount of the catalyst or additive.

Referring to FIG. 1, the fine catalyst (1) with a particle size of less than 100 microns—preferably less than 50 microns—is stored in the fine catalyst silo (2) and is fed discontinuously through valve (3) to a small weighted vessel (4) that feeds to a continuous screw feeder (5) at the appropriate fine catalyst or additive rate and is mixed with the heavy oil (16) and larger catalyst (12) in the mixing tank (13) at a fine catalyst concentration of 0.5 to 6 wt. % with a most preferred range of 0.5 to 3 wt. %.

The second feeding system is employed to feed the one-way catalyst or additive having a larger particle size which, according to this invention, should range from 100 microns to 2000 microns with a most preferred range of 700 to 7000 microns. The larger catalyst or additive (7) is stored in the larger catalyst silo (8) and is fed discontinuously through a valve (9) to a small weighted vessel (10) that feeds to a continuous screw feeder (11) at the appropriate larger catalyst or additive rate and is mixed with the heavy oil (16) and the fine catalyst or additive (6) in the mixing tank (13) at a catalyst concentration of the larger particle size based on the heavy oil of 0.5 to 13%, more preferably between 0.5 and 6.0%. The two feeding systems that are described here are not limited to this invention, other methods for feeding these two catalyst streams can be employed.

The heavy oil, fine and larger catalyst or additive in the mixing vessel (13) exits the same through line (14) and is then pumped to the operating pressure using a slurry high pressure pump (15). The fresh hydrogen (61) and the recycle gas (59) are preheated in the gas preheater (63) to a temperature of between 200° C. and 500° C. and are added to the residue oil (50') that was previously preheated in the heat recovery exchangers (49, 50) to make use of the heat of reaction of the products and is then fed to the feed preheater train (18) to reach the necessary outlet temperature to maintain the temperature in the reactor system.

The reactor system consists of 1, 2, 3 or more serially connected reactors. Preferred are 1 to 3 reactors serially connected. The reactors (20, 24, 27) are tubular reactors vertically placed with or without internals where the liquid, solid and gas are going upstream. This is where conversion takes place under temperatures of between 250°-500° C., preferably 400° and 490° C., more preferably temperatures of between 430° and 480° C., a hydrogen partial pressure of between 50 and 300 bar, and a recycle gas ratio of between 100 $Nm^3/T$ and 10000 $Nm^3/T$. By means of cold gas feeding (21, 23, 26), an almost isothermal operation of the reactors is possible.

In secondary hot separators, operated at almost the same temperature level as the reactors, the non-converted share of the used heavy and residual oils as well as the solid matter are separated from the reaction products which are gaseous under the processing conditions. The liquid product of the hot separators is cooled in a multi-step flash unit. In the case of a combined operation of liquid and gaseous phase, the overhead fraction of the hot separators, the flash distillates, as well as possible coprocessed crude oil distillate fractions are combined and added to the secondary gaseous phase reactors. Under the same total pressure as in the liquid phase, there is a hydrotreating or even a mild hydrocracking on a catalytic fixed bed under trickle-flow conditions.

After intensive cooling and condensation, gas and liquid are separated in a high-pressure cold separator. The liquid product is cooled and can then be further processed by usual refinery procedures.

From the process gas, the gaseous reaction products ($C_{1-4}$ gases, $H_2S$, $NH_3$) are separated to a large extent, and the remaining hydrogen is returned as circulation gas.

According to the present invention, two or three separated and independent feeding systems are used where fine catalyst with a particle size of less than 100 microns is fed using one feeding system and the larger catalyst with a particle size of between 100 and 2000 microns using the second feeding system, maintaining a proportion of larger catalyst particle size with respect to the total catalyst of between 5 and 80%, preferably between 5 and 30%, where the total amount of catalyst or additive based on the heavy crude is between 0.5 and 15 wt. %. We have observed that the amount of solids inside the reactor can be controlled and as a consequence the amount of liquid inside the reactor can be optimized increasing the conversion of the heavy crude in the reaction system and diminishing the preheating temperature that reduces the investment and operating costs of the feed preheating train.

We have also observed that this invention is particularly important when the gas velocity in the reactor at reaction conditions is higher than 3 cm/sec based on the transverse area of the reactor defined by its diameter, which is the gas velocity that normally is employed in industrial reactors.

We have observed that when the gas velocity in the reactor is higher than 3 cm/sec and big particles are not employed, the amount of liquid is very low reflected by its lower head pressure, lower conversion and higher preheating temperatures. Also, when the amount of big particles is very high, these big particles have a tendency to accumulate in the reactor with the course of time, decreasing the amount of liquid in the reactor and the on-stream factor of the reaction system.

It is generally preferred to add the same additive or catalyst as both fine and larger particle fractions. But it is also possible, and in some cases even advantageous, to use additives of a different composition for fine and larger particle fractions, e.g. $Fe_2O_3$ as the fine particle proportion with an upper limit of the particle size of 30 microns and lignite activated coke with a lower limit of the particle size of 100 microns.

It must be recognized that two feeding systems are not necessary to feed Tank No. 6 (FIG. 1), which is the catalyst/oil mixing tank, but that a catalyst mixture, formed by the addition of the two different catalyst particle distributions could be made beforehand in another separate device, and the catalyst mixture fed directly to vessel No. 6 (FIG. 1). The remarkable feature of the present invention is that two distinguishable particle size distributions of catalyst or additives of the same or different chemical species, are used in the reacting system.

This mixing of the two catalyst size distributions could be part of the emergency system, this also being included in the scope of the present invention.

TABLE 1

Weight vs. particle size distribution for a normal sample after milling operation (Sample A)

| d(μ) | Sample A wt. % between d(μ) | Sample A wt. % under d(μ) |
|---|---|---|
| >500 | 0 | |
| 500/315 | 1.4 | 1.4 |
| 315/200 | 26.1 | 27.5 |
| 200/125 | 16.5 | 44.0 |
| 125/90 | 11.7 | 55.7 |
| 90/69 | 11.9 | 67.6 |
| 63/45 | 10.9 | 78.5 |
| 45/32 | 6.5 | 85.0 |
| 27/21 | 4.0 | 89.0 |
| 21/15 | 3.0 | 92.0 |
| 15/10 | 3.0 | 95.0 |
| 10/7 | 2.0 | 97.0 |
| 7/5 | 2.2 | 99.2 |
| 5/2.5 | 0.8 | 100.0 |
| 2.5/1.5 | — | — |

TABLE 1-continued

Weight vs. particle size distribution for a normal sample after milling operation (Sample A)

| $d_{(\mu)}$ | Sample A wt. % between $d_{(\mu)}$ | Sample A wt. % under $d_{(\mu)}$ |
|---|---|---|
| 1.5/0.5 | — | — |
| <0.5 | — | — |

TABLE 2

Weight vs. particle size distribution for a normal sample after milling operation (Sample B)

| $d_{(\mu)}$ | Sample B wt. % between $d_{(\mu)}$ | Sample B wt. % under $d_{(\mu)}$ |
|---|---|---|
| >500 | | |
| 500/315 | | |
| 315/200 | | |
| 200/125 | | |
| 125/90 | | |
| 90/69 | | |
| 63/45 | | |
| 45/32 | | |
| 27/21 | 3.3 | 3.3 |
| 21/15 | 5.3 | 8.6 |
| 15/10 | 12.2 | 20.8 |
| 10/7 | 12.0 | 32.8 |
| 7/5 | 4.0 | 36.8 |
| 5/2.5 | 24.5 | 61.3 |
| 2.5/1.5 | 15.0 | 76.3 |
| 1.5/0.5 | 18.0 | 94.3 |
| <0.5 | 5.7 | 100.0 |

TABLE 3

Weight vs. particle size distribution for two normal samples after milling operation and for A 50% A/50% B mixture (Sample C)

| $d_{(\mu)}$ | wt. % between $d_{(\mu)}$ Sample A | Sample B | Sample C | yield under $d_{(\mu)}$ wt. % Sample C |
|---|---|---|---|---|
| >500 | | 0 | | |
| 500/315 | 1.4 | | 0.7 | 0.7 |
| 315/200 | 26.1 | | 13.0 | 13.7 |
| 200/125 | 16.5 | | 8.3 | 22.0 |
| 125/90 | 11.7 | | 5.9 | 27.9 |
| 90/69 | 11.9 | | 6.0 | 33.9 |
| 63/45 | 10.9 | | 5.5 | 39.4 |
| 45/32 | 6.5 | | 3.2 | 42.6 |
| 27/21 | 4.0 | 3.3 | 3.2 | 45.8 |
| 21/15 | 3.0 | 5.3 | 4.2 | 50.0 |
| 15/10 | 3.0 | 12.2 | 7.7 | 57.7 |
| 10/7 | 2.0 | 12.0 | 7.0 | 64.7 |
| 7/5 | 2.2 | 4.0 | 3.1 | 67.8 |
| 5/2.5 | 0.8 | 24.5 | 12.7 | 80.5 |
| 2.5/1.5 | | 15.0 | 7.5 | 88.0 |
| 1.5/0.5 | | 18.0 | 9.0 | 97.0 |
| <0.5 | | 5.7 | 2.9 | 99.9 |

TABLE 4

Weight vs. particle size distribution for two normal samples for a 30% A/70% B mixture (Sample D)

| $d_{(\mu)}$ | wt. % between $D_{(\mu)}$ Sample A | Sample B | 30% A/70% B Sample D | yield under $d_{(\mu)}$ wt. % Sample D |
|---|---|---|---|---|
| >500 | 0 | | 0 | |
| 500/315 | 1.4 | | 0.42 | 0.42 |
| 315/200 | 26.1 | | 7.83 | 8.25 |
| 200/125 | 16.5 | | 4.95 | 13.20 |
| 125/90 | 11.7 | | 3.51 | 16.71 |
| 90/69 | 11.9 | | 3.57 | 20.28 |
| 63/45 | 10.9 | | 3.27 | 23.55 |
| 45/32 | 6.5 | | 1.95 | 25.50 |
| 27/21 | 4.0 | 3.3 | 3.51 | 29.01 |
| 21/15 | 3.0 | 5.3 | 4.61 | 33.62 |

TABLE 4-continued

Weight vs. particle size distribution for two normal samples for a 30% A/70% B mixture (Sample D)

| $d_{(\mu)}$ | wt. % between $D_{(\mu)}$ Sample A | Sample B | 30% A/70% B Sample D | yield under $d_{(\mu)}$ wt. % Sample D |
|---|---|---|---|---|
| 15/10 | 3.0 | 12.2 | 9.44 | 43.06 |
| 10/7 | 2.0 | 12.0 | 9.00 | 52.06 |
| 7/5 | 2.2 | 4.0 | 3.46 | 55.50 |
| 5/2.5 | 0.8 | 24.5 | 17.39 | 72.91 |
| 2.5/1.5 | | 15.0 | 10.5 | 83.40 |
| 1.5/0.5 | | 18.0 | 12.6 | 96.00 |
| <0.5 | | 5.7 | 4.0 | 100.00 |

TABLE 5

Weight vs. particle size distribution for two normal samples for a 10% A/90% B mixture (Sample E)

| $d_{(\mu)}$ | wt. % between $d_{(\mu)}$ Sample A | Sample B | 10% A/90% B Sample E | yield under $d_{(\mu)}$ wt. % Sample E |
|---|---|---|---|---|
| >500 | 0 | | 0.14 | |
| 500/315 | 1.4 | | 2.61 | 0.14 |
| 315/200 | 26.1 | | 1.65 | 2.75 |
| 200/125 | 16.5 | | 1.17 | 4.40 |
| 125/90 | 11.7 | | 1.19 | 5.57 |
| 90/69 | 11.9 | | 1.09 | 6.76 |
| 63/45 | 10.9 | | 0.65 | 7.85 |
| 45/32 | 6.5 | | 3.37 | 8.50 |
| 27/21 | 4.0 | 3.3 | 5.07 | 11.90 |
| 21/15 | 3.0 | 5.3 | 11.30 | 16.94 |
| 15/10 | 3.0 | 12.2 | 11.00 | 28.30 |
| 10/7 | 2.0 | 12.0 | 3.88 | 39.20 |
| 7/5 | 2.2 | 4.0 | 22.13 | 43.12 |
| 5/2.5 | 0.8 | 24.5 | 13.50 | 65.25 |
| 2.5/1.5 | | 15.0 | 16.20 | 78.75 |
| 1.5/0.5 | | 18.0 | 5.10 | 94.95 |
| <0.5 | | 5.7 | | 100.00 |

In Tables 1 and 2 are presented the accumulative weight distributions of the samples A and B (larger and smaller particles respectively) which are each produced in a specific milling operation.

Figure 2:
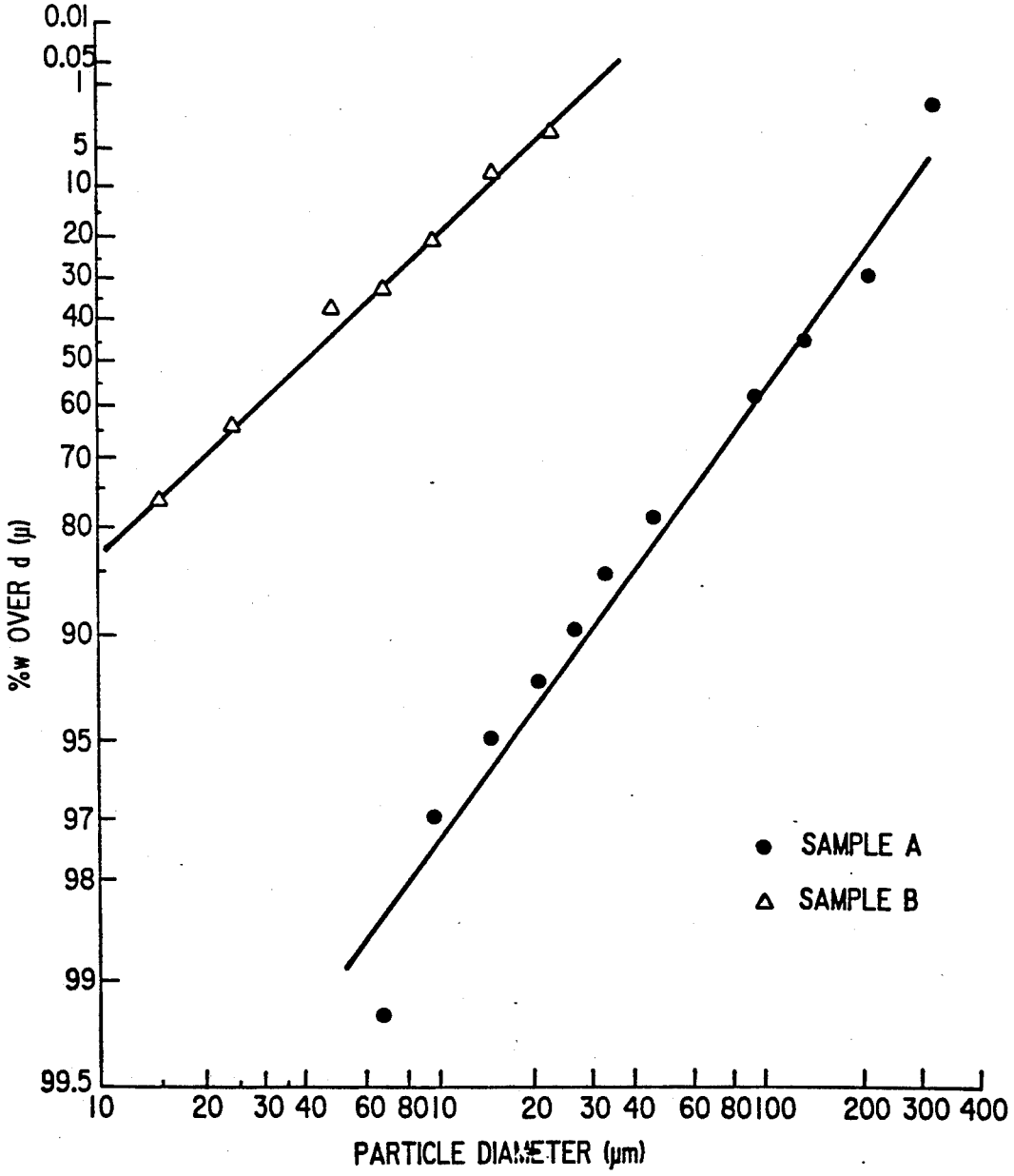
FIG. 2 shows the log (−log) versus log plot of the wt. % versus size for two normal size distributions after a milling operation.

The accumulative weight distribution of the samples A and B in Tables 1 and 2 are plotted on a log (−log) versus log graph (FIG. 2), and this graph shows that samples A and B are very nearly represented in this plot by straight lines in the range of an accumulative weight between 1 and 99%. This is coincidental with what is well known for samples produced in a straight-forward one-pass or with recycle milling operation in which a target yield under a predeterminated sieve size is given (Robert Perry, Chemical Engineers Handbook, Ed. 5, Sect. 8 "Size Reduction").

The use of closed-circuit grinding in which mill discharge is classified and the coarse material is returned to the mill is considered to be different than the present invention. This conventional procedure is not a mixing of separate catalyst streams of different sizes because in closed-circuit grinding, the target is also to obtain a certain yield under a predeterminate sieve size.

Figure 3:
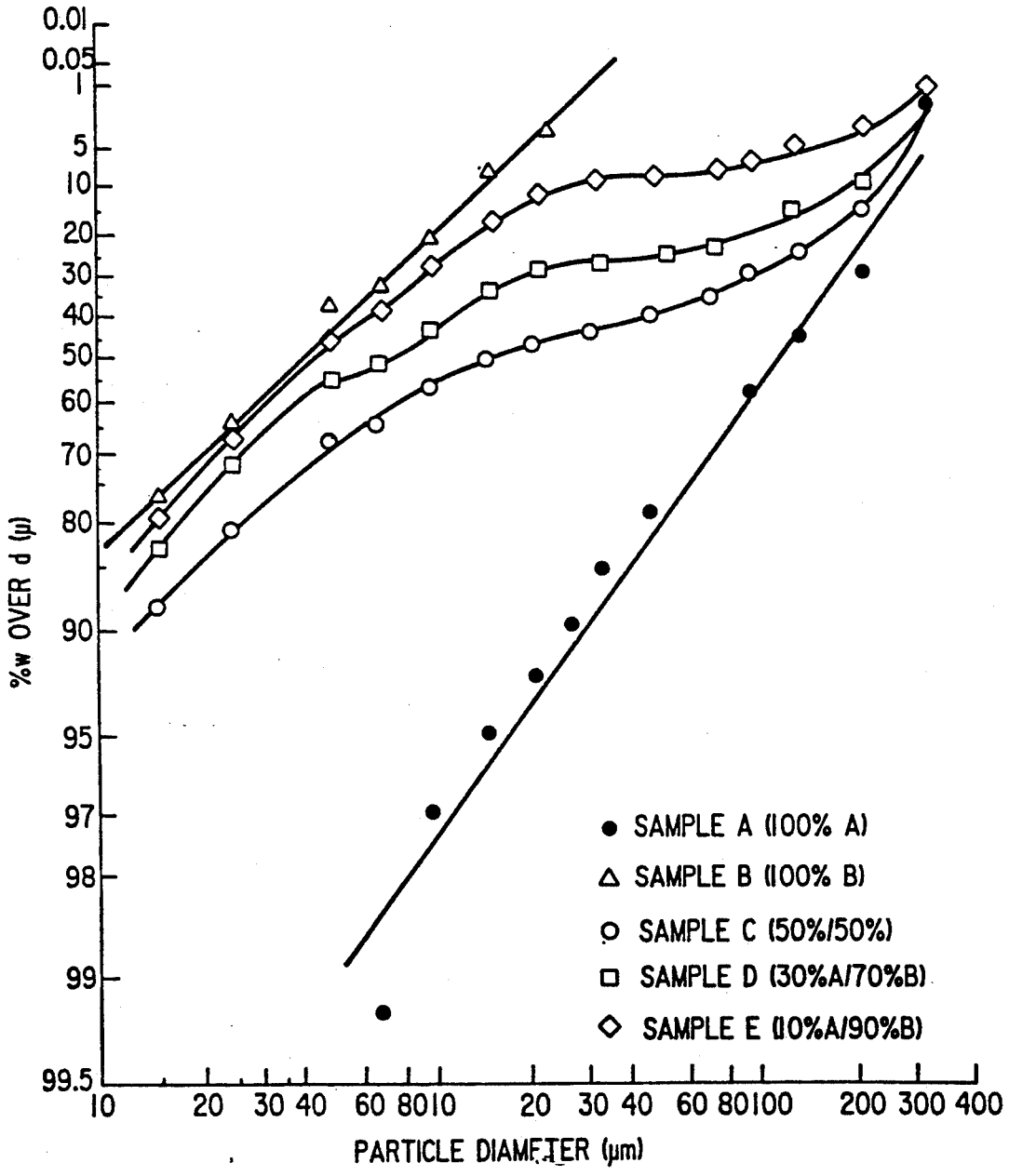
FIG. 3 shows a log (−log) versus log plot for wt. % versus size for two normal size distributions and for mixtures thereof.

In FIG. 3 are plotted the mixtures of the samples A and B which are sample C (50% A/50% B), Table 3, sample D (30% A/70% B), Table 4 and sample E (10% A/90% B), Table 5, and it is observed that these mixtures give a curve which cannot be represented by a straight line.

A mixture of two or more streams coming out from two or more separate milling operations with a certain yield under a predeterminated sieve size, differs widely from the straight line behavior given by eq.(2):

$$\% \ \eta/100 = exp\ [-a\ dp^b] \quad (1)$$

$$ln\ (-ln\ [\% \ \eta/100]) = ln a + b\ ln\ dp \quad (2)$$

where:

% $\eta$: Accumulative weight under a dp, wt % dp : particle size, microns

This provides a way to identify when a mixture of two or more particle size distributions of widely different particle sizes is being fed to the hydrocracking reactor, this being the essence of present invention. In Table 6 are presented the results of the linear regression by the mean-square fit of equation (2) and the correlation coefficient $R^2$ calculated by the equation (3) (Edwin L. Crow, STATISTICS MANUAL, p. 164).

TABLE 6

| SAMPLE | A | B | C | D | E |
|---|---|---|---|---|---|
| | Results of mean-square fit linear regression of samples A, B, C, D, and E | | | | |
| Type of sample | milling product | milling product | mixture 50% A/50% B | mixture 30% A/70% B | mixture 10% A/90% B |
| Regression coefficients in eq. (2)* | | | | | |
| LN a | −6.23 | −1.868 | −2.327 | −1.906 | −1.5642 |
| b | 1.279 | 1.044 | 0.627 | 0.606 | 0.628 |
| Correlation coefficient $R^2$ | 0.974 | 0.986 | 0.933 | 0.912 | 0.899 |

*Equation (2)

ln (− ln % $\eta$/100) = lna + bln dp

In general: (wt. %) = wt. $\%_{big}$ + wt. $\%_{fine}$ but to minimize wt. % added, wt. % = $(wt.\ \%_{big})_{min}$ + (wt. $\%_{fine}$)

$$R^2 = \frac{[n\Sigma xy - (\Sigma x)(\Sigma y)]^2}{[n\Sigma x^2 - (\Sigma x)^2][n\Sigma y^2 - (\Sigma y)^2]} \quad (3)$$

where n: number of experimental points y: ln [−ln ($\eta$/100)]

x: ln (dp)

It can be observed that the particle size distributions of sample A and sample B which are samples of a milling operation can be represented by a straight line with a correlation coefficient $R^2$ higher than 0.96 ($R^2 > 0.96$). Sample C, Sample D and Sample E are mixtures of Sample A and Sample B. When one tries to represent these mixtures as a straight line, the correlation coefficients ($R^2$) of these regressions are lower than 0.96 ($R^2 < 0.96$). This indicates that these samples cannot be well represented by a straight line. Based on this fact, the present invention covers situations in which a) two or more separate catalyst feeding devices add distinguishable catalyst particle size distributions to the hydrocracking section, and b) only one catalyst stream is added to the hydrocracking section the correlation coefficient of eq. 2 fails the test of $R^2 \leqq 0.96$ when mean-square fit is made for the full range of the size distribution ($1\% \leqq dp \leqq 99\%$).

Both situations a) and b) are analogous because the important feature of this invention is that for the first time it has been found that only a catalyst mixture which has $R^2 \leqq 0.96$ is able to simultaneously eliminate foam from hydrocracking reactors of the bubble column type and also to minimize the amount of added catalyst. As noted above, the mixture of two (or more) original milling size distributions allows one to minimize the catalyst addition to the hydrocracking reactor. This is because it has been demonstrated that the smallest particles are best suited to control polymerization reactions giving rise to coke formation. Coke formation is at its minimum when a larger proportion of fines is added, for a certain fixed percentage of total catalyst in the feed. Also, a certain amount of larger particle size catalyst has been demonstrated to be required to eliminate foam from the bubble column hydrocracking reactor. To minimize the total amount of catalyst added, it is required then to work at the minimum amount of larger particle catalyst. This can be mathematically stated as follows:

Catalyst addition can be minimized by adding just the minimum amount of the larger particle catalyst, i.e., just enough to eliminate foam formation. Two catalyst addition systems provide more flexibility to reduce the total amount of catalyst being added. Once foam formation has been controlled, the two catalyst addition systems allow one to substitute the larger particle catalyst by fine material. Since the latter is able to reduce coke formation, this in turn allows for further catalyst reduction, now of the fine catalyst, thereby minimizing the total amount of catalyst being fed to the hydrocracking reactor.

As the larger particle fraction preferably concentrates in the liquid phase reactor system, it is in many cases possible to reduce the proportion of the larger particle fraction from the amount present during the start-up phase, for example 20% by weight or more, to approximately 5% by weight or less during the operating phase. This can be accomplished by adding the fine particle size fraction without further addition of the larger particle size fraction.

In general, this same additive is used as the fine and as the larger particle size fraction. However, it is possible and in many cases advantageous to use different combinations for the fine and larger particle size fractions. For example, one may use $Fe_2O_3$ as the fine particle fraction with a maximum particle size of 30 microns and brown coal active coke with a minimum particle size of 120 microns as the larger particle size fraction.

The known impregnation of catalyst carriers with salts of metals, for example, molybdenum, cobalt, tungsten, nickel and particularly iron, can also be used in the present process. The impregnation may be performed by known methods such as neutralization of these salts or their aqueous solutions with sodium hydroxide. It is possible to impregnate both the fine particle fraction and the larger particle fraction with the metal salt solutions noted above or, alternatively, only one of the fractions may be impregnated.

A most preferred procedure then, is to feed two separate feed streams, the smaller particles and the larger particles, for the reasons stated above. In cases where a mixture is prepared before being added to the feed tank, i.e. in a separate silo, and then mixed as a solid powdery mixture, the flexibility inherent to the dual feeding system of addition is diminished when the mixture of "larger" and "smaller" particles are pre-prepared so as to feed only one stream of solid particles to the feed tank (6), although improved conditions result as can be recognized by the low value of the correlation index $R^2$ ($R^2 \leqq 0.96$).

It must also be stated that the minimization of catalyst addition to the hydrocracking reactor brings a very important advantage, not only the already indicated lower operating costs because of the use of less catalyst but also due to the fact that when smaller amounts of larger particles are added to control foam formation, less catalyst sediments in the reactor volume which consequently rises to higher conversion, for the same conditions (T, space velocity, etc.) This allows one to reduce the required reactor temperature for a predetermined conversion level which is very convenient for the whole hydrocracking operation because a lower temperature level results in less gas production and hydrogen consumption, very relevant variables for a economical operation.

This invention can also be applied to the hydrogenation of mixtures of heavy oils, residual oils, waste oils with a ground portion of lignite and/or hard coal, where the oil/coal weight ratio is preferably between 5:1 and 1:1. Coal can be used which has a corresponding proportion of larger particle fractions of 100 μm and more.

The hydrocracked products after the reaction system (28) are sent to the first of the two hot separator vessels (29) to separate the gas/vapor phase from the heavy liquid product which contains the non-converted residue and the spent catalyst or additive. The temperature of the hot separator is controlled in the range of 300° C. and 450° C. by regulation of the quench gas (32, 34) injected into the bottom of each hot separator (29, 33). The second hot separator (33) serves mainly as a guard vessel for the gas phase reactors (40, 46).

In case of the combined operation hydrocracking (LPH) reactors (20, 24, 27) and the gas phase reactors (GPH reactors) (40, 46), the top product of the second hot separator (36) the flash distillates (77) as well as crude oil distillates (36'), which have to be processed at the same time, are combined and fed to the gas phase reactors (40, 46) at the same total pressure as in the LPH reactors and at a similar temperature. The range of operating conditions in these reactors according to the invention are a pressure range between 50 and 300 bar, temperatures between 300° C. and 450° C. and a gas/liquid ratio between 50 and 10000 $Nm^3/T$. These reaction zones are conventional and are essentially a fixed bed reaction zone under trickle-flow conditions containing a conventional hydrosulfurization catalyst, or a mild hydrocracking catalyst such as group VIb or group VIII metal on a alumina support.

Effluents (48) from reaction zone (47) are intensively cooled and condensed (49, 50), preheating the fresh feed (15') to recover the heat of reaction. Gas and liquid are separated in a high pressure cold separator (52). The liquid product is depressurized and can subsequently be processed in a standard refinery.

After the cold separator (52), the gaseous reaction products are separated from the process gas (56) as far as possible. The remaining hydrogen (57) is compressed by the recycle gas compressor (58) and is recycled to the process (59). The bottom stream (32, 34) from the hot separators (29, 33) is depressurized in a multistage flash unit (65, 72) and the residue and used catalyst (73) or additive are sent to the refinery for further treatment such as low temperature carbonization processes or solids separation processes. The head product 71 from flash unit 72 is separated once more in column 75 into a gaseous component (surplus gas) and a liquid component 76 which leaves unit 75 through its bottom and is conveyed through line 77 as a flash distillate. This material is combined with crude oil distillates and the combined material passes into gas phase reactor 40.

Other features of the invention will become apparent in the course of the following descriptions of the exemplary embodiments which are given for illustration of the invention and are not intended to be limiting thereof.

EXAMPLES

Example 1

A vertical bubble column reactor without any internals and in which the temperature is regulated by the outlet temperature of a preheater system as well as by a cold gas system, is operated with the a specific weight rate (space velocity) of 1.5 $T/m^3h$ with the vacuum residue of a conventional residue oil of Venezuela at a hydrogen partial pressure of 190 bar, a $H_2$/liquid ratio of 2000 $Nm^3/T$ and a gas velocity of 6 cm/sec. Under these conditions, 2 wt. % of lignite coke with a strict upper limit for the particle size of 90 μm are added to the residue by a conventional feeding system. Subject to these operating conditions, the preheater outlet temperature of 447° C. was necessary to maintain a temperature of 455° C. inside the reactor. The differential pressure of the reactor under these conditions is approximately 100 mbar, and the residue conversion is approximately 45%.

The plant was then run with two different feeding systems; one adding 1.4 wt. % (on feed) of lignite coke all under 50 micron; the second feeding system adding 0.6 wt. % (on feed) of lignite coke with a particle size of more than 150 microns and less than 600 microns, for a total of 2 wt. %. The pressure head of the reactor increased from 100 mbar to approximately 300 mbar and the preheating outlet temperature decreased from 447° C. to 438° C. At the same time, the residue conversion rate (RU) increased from 45% to 62%.

The conversion is estimated as follows:

$$\text{conversion} = \frac{RU_{in} - RU_{out}}{RU_{in}} \times 100 =$$

$RU_{in/out}$ = mass flow residue 500° C.+ in the inlet/outlet streams

Example 2

In a continually operated hydrogenation plant with three serially connected vertical slurry phase reactors without any internals, the vacuum residue of a Venezuelan heavy oil was converted with 2 wt. % $Fe_2O_3$ with a strict upper limit of particle size of 30 microns with 1.5 $m^3H_2$ per kg residue, 6 cm/sec gas velocity, and a hydrogen partial pressure of 150 bar. In order to reach a residue conversion rate of 90%, the three serially connected slurry phase reactors were adjusted to an average temperature of 461° C. The space velocity was 0.5 kg/1h of reactor volume.

When 25% of the additive used was exchanged using a second feeding system with a screening fraction of $Fe_2O_3$ with a particle size distribution between 90 and 130 microns, the differential pressure in the reactors rose from 70 mbar to 400 mbar. At a constant conversion rate of 90%, the reactor temperature became 455° C. At a space velocity of 0.75 kg/1h, a residue conversion of 78% was reached with an average reactor temperature of 455° C., and a residue conversion of 90% with an average reactor temperature of 461° C.

In the following table these points are summarized:

| Sample | Additive 2 wt. % $Fe_2O_3$ | Space Velocity (kg/lh) | Average temperature (°C.) | Conversion temperature (%) |
|---|---|---|---|---|
| A | 100 wt. % 30 μm | 0.5 | 461 | 90 |
| B | 75 wt. % 30 μm<br>25 wt. % 90–130 μm | 0.5 | 455 | 90 |
| C | as in B | 0.75 | 455 | 78 |
| D | as in B | 0.75 | 461 | 90 |

With the use of two additive mixtures which are different with regard to their particle size ranges, an increase of 50% in space velocity in the bottom phase reactors (specific weight rate) is possible, employing the same reaction temperature level.

Example 3

In order to demonstrate the effect of the two separated and independent feeding systems, a test was conducted feeding a lignite coke additive employing only one feeding system. This additive had 30 wt. % of a particle size larger than 100 microns and less than 500 microns.

Employing this particles size distribution and a Venezuelan heavy crude, a test of 826 hours was conducted in a three slurry reactor system, operating at approximately 460° C. average reactor temperature, pressure of 260 bar to 205 bar, 2% to 3% catalyst based on the residue feed, gas/liquid ratio of between 1800 to 2700 $Nm^3/T$ and a gas velocity of approximately 6 cm/sec. In Table 7 the results are presented and it can be seen that the reactor differential pressure in the first reactor slowly but continuously increased during the course of time, due to solids accumulation. The increase of the differential pressure could not be reduced, either, when the amount of catalyst was reduced from 3 to 2%. As a consequence, a slow decrease of the conversion rate was observed with time due to solids filling the reaction volume reducing the effective reaction volume for the hydrocracking reactor. These results show that by this feeding-system method, after some time the reactor is filled with solids. A large reaction volume is lost, reducing the conversion in the reactor system, and making this method unsuitable as an industrial operation.

TABLE 7

EXPERIMENTAL INFORMATION
PRESSURE DROP IN REACTOR DC-1310
Feed: Venezuelan heavy crude
(Gas velocity approx. 6 cm/sec)
Pressure from 260 bar to 205 bar
Gas/liquid ratio between 1.800 $Nm^3T$ and 2.700 $Nm^3/T$

| | | | | | | | | | |
|---|---|---|---|---|---|---|---|---|---|
| Average reactor temperature, °C. | 460 | 460 | 460 | 460 | 460 | 460 | 460 | 460 | 461 |
| wt. % additive* | 3 | 3 | 3 | 3 | 3 | 3 | 3 | 2 | 2 |
| Residue conversion, wt. % | 94.0 | 94.0 | 93.0 | 94.0 | 92.0 | 89.0 | 93.0 | 93.0 | 79.0 |
| Diff. P (PDRA 13009), mm bar first reactor | 305 | 305 | 320 | 330 | 325 | 330 | 360 | 355 | 405 |
| Hours in operations | 52 | 61 | 111 | 204 | 279 | 321 | 699 | 783 | 826 |

*additive with 30% of particle size between 100 and 500 microns

Figure 4:
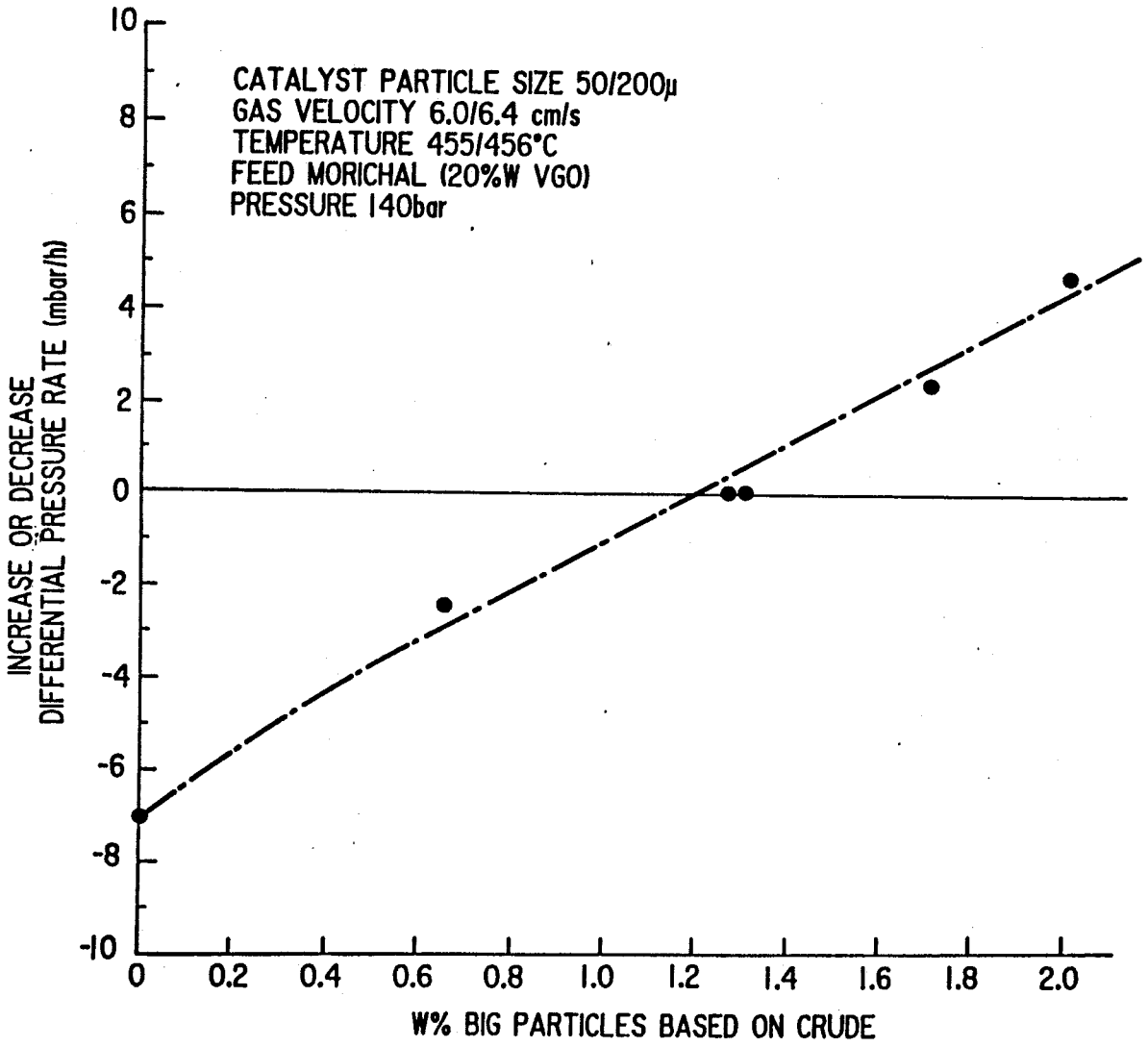
FIG. 4 shows a graph illustrating the effect of large particles on the rate of pressure increase in the pressure head of the first reactor.

On the other hand when the two separate and independent feeding systems of this invention were employed, it was observed that the pressure head in the reactor could be controlled (FIG. 4), increasing or decreasing it depending on the amount of big particles (50–200 microns with 70% > 100 microns) employed. When the catalyst particles were fed using two separate and independent feeding systems, one for the small particles of less than 30 microns and the other for big particles 50–200 microns, the behaviour of the pressure head in the reactors was completely stable in spite of maintaining them completely filled with the slurry phase.

The pressure head increased at a rate of 5 mbar/h when 2 wt. % of larger particles (50–200 microns with 70% > 100 microns) and 2% of fine particles (less than 30 microns) were employed; when the larger particle feeding system was stopped, the pressure head decreased at a rate of −7 mbar/h, maintaining a 4% catalyst only with small particles. This test was conducted at 140 bar total pressure, 1500 $Nm^3/T$ gas/liquid ratio and 6 cm/sec gas velocity. This example clearly shows the advantage of employing the two feeding systems to limiting the amount of solids inside the reactor and as a consequence the amount of liquid inside it, thus permitting an effective control over conversion and preheater outlet temperature.

Example 4

A natural mineral containing $Fe_2O_3$ catalyst with less than 20 microns particle size was fed using one of two feeding systems. The second one was employed to feed larger particles with particle size of less than 300 microns with 50 wt. % content of particles smaller than 100 microns.

This dual catalyst stream was fed in a total amount of 3.1% based on heavy oil feed to the reaction system. The heavy oil employed was Morichal vacuum residue. The total pressure employed in the test was 170 bar with 130 bar hydrogen partial pressure, 7.8 cm/sec gas velocity in the reactor system, 1700 $Nm^3/T$ recycle gas; an average reaction temperature of 464° C. and a specific throughout (space velocity) of 0.7 $T/m^3h$ (Table 8).

With these operating conditions with 1.1 wt. % based on crude of fine particles (less than 20 microns) in one feeding system, with 2.0 wt. % based on crude of larger particles (less than 300 microns containing 50 wt. % of the catalyst having a particle size of less than 100 microns), in the second feeding system, the residue conversion was 92.0% and the asphaltene conversion was 90.0% with a coke production of 1.2% (Test 1, Table 8).

When with the same operating conditions the amount of small particles (less than 30 microns) using one feeding system was reduced to 0.6% and the amount of bigger particles (less than 300 microns with 50 wt. % less than 100 microns) in the second feeding system was increased to 2.5% based on the crude, maintaining a constant total 3.1% catalyst, the crude conversion was maintained at 92%, but the asphaltene conversion decreased to 65% and the coke yield increased to 2.5% giving plugging problems in the hot separator (Test 2, Table 8).

TABLE 8

Effect of the two particle size distribution on the total amount of catalyst and plant operability

| | |
|---|---|
| Pressure: | 170 bar |
| $H_2$ partial pressure: | 130 bar |
| Gas velocity: | 7.8 cm/sec. |
| Gas/Liquid Ratio: | 1.700 $Nm^3/h$ |
| Aver. Reactor Temperature: | 464° C. |
| Space Velocity: | 0.7 $T/m^3h$ |

| Test | % smaller particles 20 μm | % longer particles 300 μm | % total amount of catalyst | residue conv. 500° C.+ | asphaltenes conv. % | coke prod. % | pilot plant operability |
|---|---|---|---|---|---|---|---|
| 1 | 1.1 | 2.0 | 3.1 | 92 | 90 | 1.2 | very good |
| 2 | 0.6 | 2.5 | 3.1 | 90 | 65 | 2.5 | * |
| 3 | 1.1 | 2.5 | 3.6 | 92 | 90 | 1.2 | very good |
| 4 | 1.1 | 2.0 | 3.1 | 92 | 90 | 1.2 | very good |

*plugging problems in hot separator due to high asphaltenes contained in the non-converted residue.

In this situation, the amount of larger particles is increased up to 2.5% (Test 3) and the previous conversion results are recovered (92% residue conversion, 90% asphaltene conversion), but with 3.6 wt. % total catalyst, which is 0.5% higher than the Test 3 (Table 8).

When the initial operating conditions were reestablished, the 90% asphaltene conversion and 1.2% coke yield were recovered.

Summarizing, the charge of a non-normal catalyst size distribution to a bubble column hydrocracking reactor minimizes catalyst addition and reaction severity; said non-normal catalyst size distribution can be achieved through several means: a) the mixing of two or more different normal size distributions, to give a mixture characterized by $R^2<0.96$, at any place in the catalyst production system and b) the separate addition of two or more size distributions ($R^2 \geqq 0.97$) to any place of the reacting system before or at the entrance to the hydrocracking reactor.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A catalyst for the hydrogenation of a hydrocarbon material, said catalyst being a member selected from the group consisting of red mud, iron oxides, iron ores, hard coals, lignites impregnated with heavy metal salts, carbon black, soots from gasifiers, and cokes produced by the hydrogenation of virgin residues and said catalyst comprised of at least two separate particle size fractions such that the combined fractions have a particle size distribution between 0.1 and 2,000 microns with 10–40 wt. % of the particles having a particle size greater than 100 microns, and the mixture of fractions not being represented by a straight line when the accumulative weight of the particles versus particle size which is plotted on log (−log) versus log graph paper has a correlation coefficient ($R^2$) less than 0.96 as determined from the equation:

$$R^2 = \frac{[n\Sigma xy - (\Sigma x)(\Sigma y)^2]}{[n\Sigma x^2 - (\Sigma x)^2][n\Sigma y^2 - (\Sigma y)^2]}$$

wherein n is the number of experimental points, y is ln and x is ln (dp), wherein dp is the particle size (μm) of the particles.

2. The catalyst of claim 1, wherein said combined fractions have a particle size distribution between 0.1–1000 microns.

3. The catalyst of claim 1, wherein 10–30 wt % of said catalyst has a particle size greater than 100 microns.

4. The catalyst of claim 1, wherein said 10–40 wt. % particle size fraction has a particle size of greater than 100 to 1000 microns.

5. The catalyst of claim 1, wherein said 10–40 wt % particle fraction ranges in an amount of from 20–40 wt %.

6. The catalyst of claim 5, wherein said 20–40 wt. % particle fraction contains ground lignite or hard coal.

7. The catalyst of claim 1, wherein said 10–40 wt. % particle fraction comprises different materials.

8. The catalyst of claim 1, wherein said at least two particle fractions are selected from the group consisting of red mud/hard coal, carbon black/hard lignite, ground lignite/ground lignite, iron ores/hard coal-ground lignite, iron ores/iron ores, iron ores/cokes from hard coal or residues, and iron ores/soots from gasification processes.

9. The catalyst of claim 1, wherein said 10–40 wt % particle fraction further comprises calcium or magnesium compounds which improve the hydrogenation activity of the catalyst.

* * * * *

UNITED STATES PATENT AND TRADEMARK OFFICE

CERTIFICATE OF CORRECTION

PATENT NO. : 5,166,118

DATED : November 24, 1992

INVENTOR(S) : Klaus Kretschmar et al.

It is certified that error appears in the above-identified patent and that said Letters Patent is hereby corrected as shown below:

On the title page, Item [62],

The Related U.S. Application Data is incorrect, should read as follows: --Division of Ser. No. 105,290, Oct. 7, 1987, Pat. No. 4,851,107--.

Signed and Sealed this

Nineteenth Day of October, 1993

*Attest:*

*Attesting Officer*

BRUCE LEHMAN

*Commissioner of Patents and Trademarks*

UNITED STATES PATENT AND TRADEMARK OFFICE

CERTIFICATE OF CORRECTION

PATENT NO. : 5,166,118

DATED : November 24, 1992

INVENTOR(S) : Klaus Kretschmar et al

It is certified that error appears in the above-indentified patent and that said Letters Patent is hereby corrected as shown below:

| Col. | Line | |
|---|---|---|
| 7, | 37, | Under sample B delete "O" and insert --0-- under Sample A; |
| 12, | 31, | delete "the"; |
| 15, | 24, | delete "bigger" and insert --larger--; |
| 15, | 39, | In Table 8, delete "% longer" and insert --% larger--; |
| 16, | 23, | delete "$[n\Sigma xy - (\Sigma x)(\Sigma y)^2]$" and insert --$[n\Sigma xy - (\Sigma x)(\Sigma y)]^2$-- |
| 16, | 27, | before "and" insert -- [-ln(n/100)] --; |
| 16, | 58, | insert --separate-- after "two"; |

UNITED STATES PATENT AND TRADEMARK OFFICE

CERTIFICATE OF CORRECTION

PATENT NO. : 5,166,118

DATED : November 24, 1992

INVENTOR(S) : Klaus Kretschmar et al

It is certified that error appears in the above-indentified patent and that said Letters Patent is hereby corrected as shown below:

Column 16, line 27, before "and" insert -- [-in(n/100)] --.

Column 16, line 58, insert --separate-- after "two".

Signed and Sealed this

Twelfth Day of April, 1994

Bruce Lehman

*Attest:*

BRUCE LEHMAN

*Commissioner of Patents and Trademarks*

*Attesting Officer*